United States Patent [19]

Van Horn

[11] 4,193,201

[45] Mar. 18, 1980

[54] SOLDERLESS ELECTRICAL CONNECTOR CONSTRUCTION

[75] Inventor: Robert H. Van Horn, Worthington, Ohio

[73] Assignee: Bell Telephone Laboratories, Incorporated, Murray Hill, N.J.

[21] Appl. No.: 964,452

[22] Filed: Nov. 29, 1978

[51] Int. Cl.[2] ..... H01R 13/38

[52] U.S. Cl. ..... 339/98

[58] Field of Search ..... 339/97 R, 97 P, 98, 339/99 R

[56] References Cited

U.S. PATENT DOCUMENTS

| | | | |
|---|---|---|---|
| 2,738,479 | 3/1956 | Gibson | 339/98 |
| 3,599,172 | 8/1971 | Tuchto | 339/98 |
| 3,611,264 | 10/1971 | Ellis, Jr. | 339/99 R |
| 3,808,582 | 4/1974 | Aldridge et al. | 339/99 R |
| 3,860,318 | 1/1975 | Reavis, Jr. et al. | 339/99 R |
| 4,046,446 | 9/1977 | Reavis, Jr. | 339/99 R |
| 4,047,785 | 9/1977 | Jayne | 339/99 R |
| 4,053,197 | 10/1977 | Teagno | 339/99 R |
| 4,084,878 | 4/1978 | Wahi | 339/99 R |
| 4,099,822 | 7/1978 | Carlisle et al. | 339/98 |

*Primary Examiner*—Joseph H. McGlynn
*Attorney, Agent, or Firm*—William H. Kamstra

[57] ABSTRACT

A solderless electrical connector construction for making connections between a plurality of conductor pairs (23) and a corresponding row of single, double-bladed (16, 17) insulation-piercing terminals (11) extending from the top surface (12) of a terminal block (10). The blades (16, 17) are oppositely directed from the ends of the terminals (11) and are adapted to seize and pierce the insulation of conductor pairs (23) maintained in vertical channels (21) in a pair of conductor mounting blocks (20, 30) as the latter are closed into abutment along the surface (12) of the terminals block (10). The channels (21) are extended around the mounting blocks (20, 30) to provide strain relief.

8 Claims, 4 Drawing Figures

SOLDERLESS ELECTRICAL CONNECTOR CONSTRUCTION

TECHNICAL FIELD

This invention relates to electrical connector constructions and particularly to such constructions adapted to facilitate the solderless connection of the conductors of multiconductor cables to corresponding connector contact terminals.

BACKGROUND ART

Although the physical design of communications and electronics systems has in recent years seen extensive advances in terms of simplification, miniaturization, ciruit integration, and the like, the interconnection between system components and mounting frames still relies largely on individual conductors assembled in cables for power distribution and signal transmission. In most systems, terminations from the many circuit units are collected at common points where terminals are provided to which individual cable conductors are joined. Although the art has offered improvements in terminating arrangements for making the electrical connections between the terminals and individual conductors, the problems of facilitating and speeding the individual joining of conductors and terminals without adding complexity and cost remain.

One well-known solderless connection arrangement employs a terminal presenting a bifurcated blade which is adapted to slice through the conductor insulation, which blade at the same time seizes the bared conductor to make the electrical connection. This arrangement has the obvious advantages that, not only is the tedious and time-consuming previous soldering step eliminated, but the necessity for first stripping the conductor insulation is also avoided. Conventionally, the individual cable conductors are first sorted and arranged on a first insulative member mounting the conductors in a pattern corresponding to the spacings of terminal blades retained in a second insulative block member. The two members are adapted to be fitted one to the other during which the blades function as described to make the electrical connections. A unitary connector assembly is thus realized which may be readily separated to permit wiring changes and repair of the connections.

As mentioned, such insulation piercing connections have long been known in the art. One such connector arrangement is disclosed, for example, in the patent of B. C. Ellis, Jr., U.S. Pat. No. 3,611,264, issued Oct. 5, 1971, in which arrangement a plurality of bifurcated blade terminals make simultaneous electrical connections with corresponding conductors held in alignment between the teeth of an indexing strip. In this and other known arrangements, single conductors make contact with individual bladed terminals. It frequently becomes necessary, however, to terminate more than one conductor on a corresponding individual bladed terminal. A bladed terminal for making such two-conductor connections is disclosed, for example, in the patent of R. P. Reavis, Jr., U.S. Pat. No. 4,040,446, issued Sept. 6, 1977. A terminal is there described which incorporates two bifurcated blades in one terminal structure, the blades lying one above the other. The cutting portions of the blades, however, appear at opposite ends of the bifurcations, that is, the cutting portion of one blade is presented at the open end of the bifurcation while that portion of the other blade is presented at the base of the bifurcation. A first conductor, as it is manually forced between both blade bifurcations, is seated to the base of the latter blade where its insulation is pierced. A second conductor is then also forced between both blade bifurcations but only so far as the cutting edges of the other blade at its open end. Two conductors are thus sequentially connected to the two-bladed terminal. Although dual connections to a single terminal may in this manner be reliably achieved, the individual insertion of what, in many cases, may be large numbers of conductor pairs in their respective double-bladed terminals remains tedious and time-consuming and, therefore, costly.

Typically, electrical connector arrangements of the character described in the foregoing also provide some form of strain relief for the cable conductors. This is frequently necessary to prevent inadvertent interruption of the electrical connections by sudden stresses applied to the conductors. This conductor strain relief has in the past been provided by adding structure integral with the connector assembly or by such structure comprising an adjunct to the assembly. In either case, the strain relief means has added to complexity and, therefore, cost to the connector assembly. It is to the problems of simplifying and facilitating the connection of large numbers of conductor pairs to their respective individual terminals to which the connector arrangement of this invention is chiefly directed. The connector arrangement of the invention is also directed to the associated problem of simplifying the means for achieving conductor strain relief.

SUMMARY OF THE INVENTION

The electrical connection of a plurality of insulated conductor pairs to corresponding single, insulation piercing terminals is simplified and facilitated in accordance with this invention in a connector assembly construction comprising, as one component, a base block having a row of insulation piercing terminals extending from one surface thereof. Each of the terminals is formed in a substantially "T" shape to present a pair of oppositely directed, insulation piercing, bifurcated blades at the crossbar. A pair of conductor mounting blocks maintain the conductors in "U" shaped channels formed therein spaced to correspond to the spacings of the block terminals. The mounting blocks are also formed to provide cavities at the conductor spacings to admit the conductor insulation piercing blades of the connector terminals. After the conductors are fitted into and around the channels of each of the mounting blocks, the connector construction is simply assembled by laterally sliding the mounting blocks along the terminal surface of the base block toward the terminals at each side of the row. As each block is thus fitted, the conductors are forced between the terminal blade bifurcations to complete the electrical connections. The connector assembly is completed as the opposing faces of the mounting blocks meet, at which point they are locked together by suitable snap fasteners, for example. Advantageously, strain relief is provided by the force-fit of the conductors in the "U" shaped channels provided therefor in the mounting blocks, in which channels the conductors are doubled back to prevent inadvertent withdrawal from the terminal blades. Strain relief is thus provided without the necessity of adding, either integrally or externally, structure for clamping the conductors.

BRIEF DESCRIPTION OF THE DRAWING

The features and advantages, together with the organization and operation of a connector assembly construction according to the principles of this invention, will be better understood from a consideration of the detailed description of one specific illustrative connector construction embodiment thereof which follows when taken in conjunction with the accompanying drawing in which.

DETAILED DESCRIPTION

Figure 1:
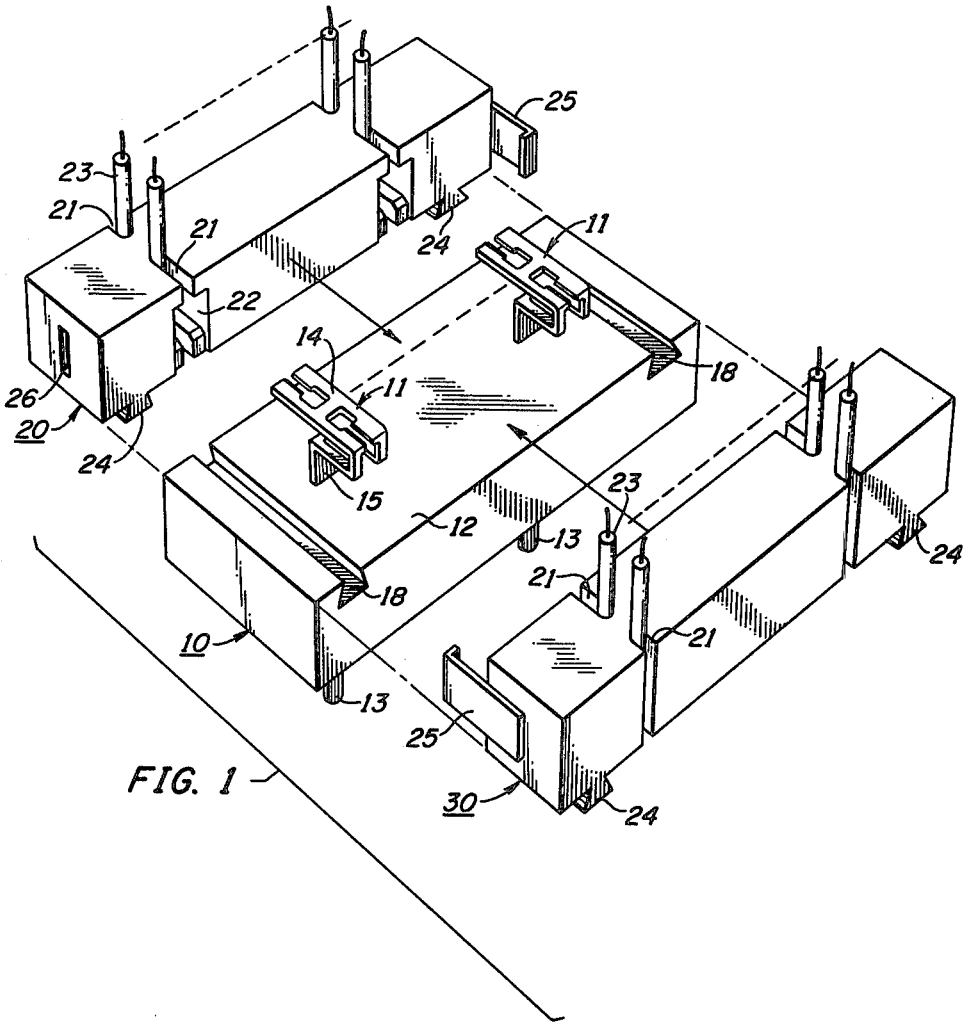
FIG. 1 is a perspective view of an illustrative connector construction according to this invention showing the components before their final fitting together.

The components of one illustrative electrical connector construction according to this invention are shown in FIG. 1 immediately before their final assembly, the components comprising a terminal base block 10, and a pair of conductor mounting blocks 20 and 30, each being formed of any suitable electrically insulative material. Terminal block 10 is generally of a rectangular configuration having a row of equally spaced insulation piercing terminals 11 extending upwardly from a top surface 12 thereof, only representative terminals 11 being shown in the figure. Terminals 11 are imbedded in block 10 and extend therethrough to terminate at the undersurface of block 10 in any known means for making electrical connections thereto. Thus, terminals 11 may present at their ends terminal lugs 13 or, as in other known arrangements, block 10 may be slotted at its underside to admit the edge terminals of a printed wiring board, for example, terminals 11 then having suitable provisions at their ends for completing the electrical connections. In any case, specific applications and further interconnections of a connector construction according to this invention are readily envisioned by one skilled in the art.

Figure 2:
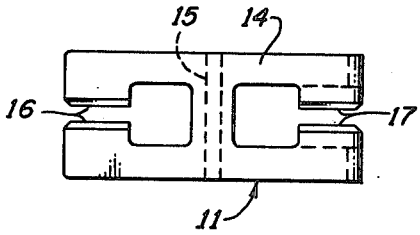
FIG. 2 is an enlarged top view of one illustrative insulation piercing terminal contemplated for use in a connector according to this invention.

Each of the terminals 11 comprises at its operative end a substantially "T"-shaped member formed of an electrically conductive strip. In the specific, illustrative connector construction being described, the "T" configuration is achieved by first bending the strip 90 degrees to one side and then doubling the thus bent end back 180 degrees to form a crossbar 14 and a stem 15. As shown in the top view of a terminal 11 in FIG. 2, each end of crossbar 14 thus formed is bifurcated to present a pair of opposing blades 16 and 17, the bifurcations being dimensioned to receive by force-fit, the bared conductor of a cable with which electrical connections are to be made. The lower bifurcation of the doubled end of crossbar 14 is dimensioned to freely admit the outer diameter of such a conductor as insulated. Although a "T" shaped termination was achieved as described in the foregoing by simply bending the terminal strip, it will be appreciated that the same functional structure may be realized by welding or otherwise affixing a separate crossbar at its center-point to the stem.

Each of the conductor mounting blocks 20 and 30 is also formed in a generally rectangular configuration and is dimensioned in length substantially to be the same as the length of terminal block 10 and in width to be half that of the latter block. Since blocks 20 and 30 may be formed identically for economy of fabrication, only the details of block 20 need be described for an understanding of the invention. As shown in FIG. 1 and more clearly in the section view of FIG. 3, block 20 has formed therein a plurality of "U"-shaped slots or channels 21, only representative ones of which are shown, extending from the top surface of the block at one side to the same surface at the other side. Channels 21 are spaced to correspond to the spacings of the bifurcated blades of terminals 11 of block 10 and are dimensioned to have force-fitted therein the conductors of the cable with which electrical connections are to be made. In addition to the channels 21, block 20 also has formed therein at the latter channels, a plurality of cavities 22, only representative ones of which also being shown, each dimensioned and shaped to freely admit the largest outer dimensions of a terminal 11, in this case, the dimensions of the doubled end of a crossbar 14. Thus dimensioned a cavity 22 will then also freely admit the other end of a crossbar 14. Further details of blocks 10, 20 and 30 will be considered in connection with a description of the assembly of the connector construction of this invention which follows.

Figure 3:
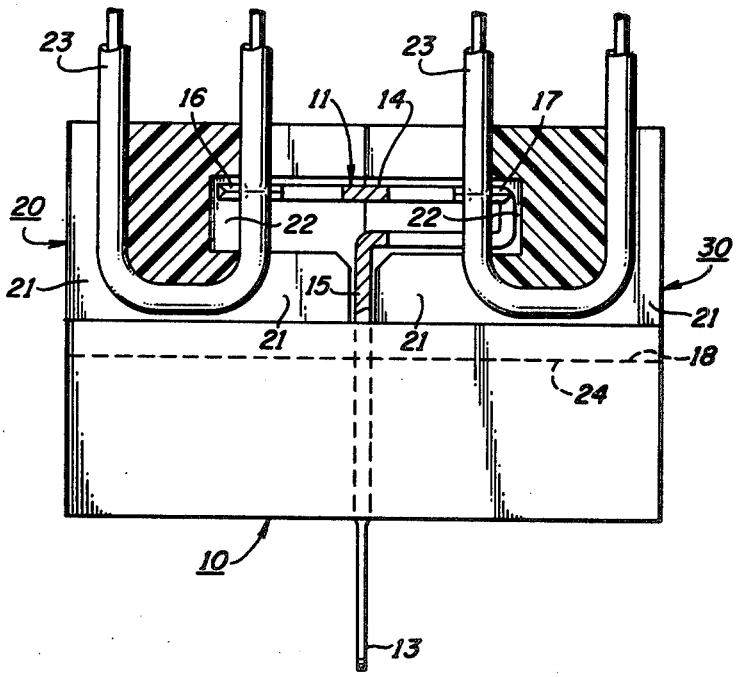
FIG. 3 is an enlarged, partially sectioned view of a connector construction according to this invention after assembly showing the disposition of a pair of conductors and a terminal.

As shown in FIG. 1 and 3, each of the mounting blocks 20 and 30 is loaded with conductors 23 by inserting them in channels 21 from one side of the block, around the base of the channel, to emerge at the other side at the same surface to complete a wrap about the blocks within the channels. From the general positions of the blocks 20 and 30 shown in FIG. 1, the blocks are moved along surface 12 of terminal block 10 toward the bifurcated blades of terminals 11 as indicated by the directional arrows. In order to provide accurate alignment for the operative elements of blocks 10, 20, and 30, block 10 is conveniently mortised to present two guide slots 18 in which tenons 24 of blocks 20 and 30 may be dovetailed during assembly. Mortises 18 and tenons 24 also provide locking means for partially securing the connector assembly. As blocks 20 and 30 are fitted as described, conductors 23 are seized by the bifurcated blades 16 and 17 which pierce the conductor insulation in a known manner to complete the electrical connections between the now bared conductors and connector terminals. The fitting of blocks 20 and 30 is continued until the opposing side faces of the blocks meet. At this point, a suitable latching means, such as a clip 25 provided at one end of each of the blocks 20 and 30, holds the blocks securely together. Clip 25 has provided at its end a detent which is adapted to engage a slot 26 presented at the other end of each of the blocks 20 and 30.

Figure 4:
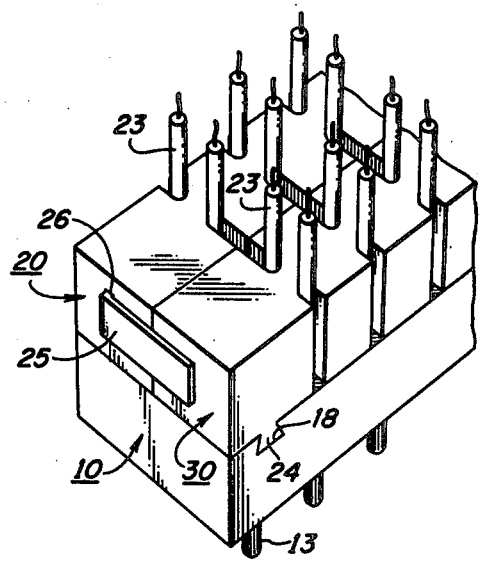
FIG. 4 depicts in perspective view a portion of the connector construction of FIG. 4 after assembly showing an illustrative locking mechanism for achieving a unitary construction.

As shown in FIG. 4, a unitary connector assembly is thus realized which may be readily disassembled for maintenance and wiring changes, the simple components of which are adapted for mass molding or other manufacture. Advantageously, the construction provides conductor strain relief by the forced wrap of the conductor about the channeled mounting blocks.

Although in the foregoing, a plurality of two conductor connections to a corresponding plurality of single terminals was contemplated, it will be appreciated that, as suggested in FIG. 3, four circuit connections may be completed to a single terminal should this versatility be required.

Further, although the illustrative embodiment of the invention was described as terminating a pair of conductors on a single double-ended terminal, the organization and operation of the invention equally lend themselves to a construction in which the oppositely directed insulation-piercing blades are respective parts of separate and individual terminals for single conductor terminations. Accordingly, it is to be understood that what has been described is considered to be only one illustrative connector arrangement according to the principles of the invention and various and numerous other arrangements may be devised by one skilled in the art without departing from the spirit and scope of the invention as limited only by the accompanying claims.

What is claimed is:

1. An electrical connector construction including a terminal block (10) having a row of terminal means (11) extending from a surface (12) of said terminal block (10), characterized in that each of said terminal means (11) comprises first and second oppositely directed, insulation-piercing blades (16, 17), a first block (20) is provided having a row of cavities (22) therein on one side face to receive corresponding ones of said first blades (16) and further having conductor receiving channels (21) formed therein on said one face perpendicular to and in registration with said first blades (16), and in that a second block (30) is provided also having a row of cavities (22) therein on one side face to receive corresponding ones of said second blades (17) and further also having conductor receiving channels (21) formed therein on said one face perpendicular to and in registration with said second blades (17), and further in that said first and second blocks (20, 30) are fitted into abutment at said side faces along said surface of said terminal block (10) for connecting conductors (23), when fitted in said channels (21), between said blades (16, 17) of said terminal means (11).

2. An electrical connector construction including a terminal block (10) having a row of terminal means (11) extending from a surfacce (12) of said terminal block (10) characterized in that each of said terminal means (11) comprises a substantially "T"-shaped member, a first and second oppositely directed insulation-piercing blade (16, 17) being formed at opposite ends of the crossbar (14) of said member, a first block (20) is provided having a row of cavities (22) therein on one side face to receive corresponding first ends of said crossbar (14) and further having conductor receiving channels (21) formed therein on said one face perpendicular to and in registration with said first blades (16), and in that a second block (30) is provided also having a row of cavities (22) therein on one side face to receive corresponding opposite ends of said crossbar (14) and further also having conductor receiving channels (21) formed therein on said one face perpendicular to and in registration with said second blades (17), and further in that said first and second blocks (20, 30) are fitted into abutment at said side faces along said surface of said terminal block (10) for connecting conductors (23), when fitted into said channels (21), between said blades (16, 17) of said terminal means (11).

3. An electrical construction according to claim 1 or 2 further characterized in that each of said first and second blocks (20, 30) also has conductor receiving channels (21) formed therein on the opposite side faces perpendicular to and in registration with said first and second blades (16, 17), said channels (21) on each of said faces of each of said blocks (20, 30) being connected by channels (21) in the bases of said blocks (20, 30) for fitting conductors (23) about said blocks (20, 30).

4. An electrical connector construction according to claim 3 further characterized in that said terminal block (10) is mortised (18) on said surface (12) to receive tenons (24) provided on the bases of said first and second blocks (20, 30) for securing said last-mentioned blocks to said terminal block (10).

5. An electrical connector construction according to claim 4 further characterized in that latching means (25, 26) are provided at the ends of each of said first and second blocks (20, 30) for securing said last-mentioned blocks together.

6. An electrical connector construction comprising a terminal block having a row of terminal means extending from a surface of said terminal block, each of said terminal means comprising first and second oppositely directed, insulation-piercing blades, a first conductor mounting block having a row of cavities therein on one side face for receiving corresponding ones of said first blades and further having conductor receiving channels formed therein on said one face perpendicular to and in registration with said first blades, and a second conductor mounting block having a row of cavities therein on one side face for receiving corresponding ones of said second blades and further having conductor receiving channels formed therein on said one face perpendicular to and in registration with said second blades, said first and second blocks being fitted into abutment at said side faces along said surface of said terminal block for connecting conductors, when fitted into said channels, between said blades of said terminal means.

7. An electrical connector construction as claimed in claim 6 in which each of said terminal means comprises a substantially "T"-shaped member, said first and second blades being formed at opposite ends of the crossbar of said member.

8. An electrical connector construction as claimed in claim 6 or 7 in which each of said first and second blocks also has conductor receiving channels formed therein on the opposite faces perpendicular to and in registration with said first and second blades, said channels on each of said faces of each of said blocks being connected by channels in the bases of said blocks for fitting conductors about said blocks.

* * * * *

UNITED STATES PATENT AND TRADEMARK OFFICE

CERTIFICATE OF CORRECTION

PATENT NO. : 4,193,201

DATED : March 18, 1980

INVENTOR(S) : Robert Hibbard Van Horn

It is certified that error appears in the above-identified patent and that said Letters Patent are hereby corrected as shown below:

Column 6, Claim 3, line 6, after "electrical" insert --connector--.

Signed and Sealed this

*Second* Day of *December 1980*

[SEAL]

*Attest:*

SIDNEY A. DIAMOND

*Attesting Officer*

*Commissioner of Patents and Trademarks*